US011628678B2

(12) United States Patent
Oida

(10) Patent No.: US 11,628,678 B2
(45) Date of Patent: Apr. 18, 2023

(54) TAPE PRINTING DEVICE AND METHOD OF CONTROLLING TAPE PRINTING DEVICE

(71) Applicant: SEIKO EPSON CORPORATION, Tokyo (JP)

(72) Inventor: Masahiro Oida, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 130 days.

(21) Appl. No.: 17/215,099

(22) Filed: Mar. 29, 2021

(65) Prior Publication Data

US 2021/0300080 A1 Sep. 30, 2021

(30) Foreign Application Priority Data

Mar. 30, 2020 (JP) ..... JP2020-059826

(51) Int. Cl.
*B41J 11/66* (2006.01)
*B41J 3/407* (2006.01)

(52) U.S. Cl.
CPC ..... *B41J 11/663* (2013.01); *B41J 3/4075* (2013.01)

(58) Field of Classification Search
CPC ..... B41J 3/4075; B41J 11/663; B41J 11/42; B41J 11/703; B41J 13/00; B41J 13/0009; B41J 15/00; B41J 15/04; B41J 15/044; B41J 15/046
See application file for complete search history.

(56) References Cited

U.S. PATENT DOCUMENTS

2015/0246567 A1 9/2015 Kawai
2016/0096382 A1* 4/2016 Kojima ..... B41J 11/04 347/220
2016/0271980 A1 9/2016 Sasaki

FOREIGN PATENT DOCUMENTS

JP 2015-074096 A 4/2015
JP 2015-164760 A 9/2015

* cited by examiner

*Primary Examiner* — Kristal Feggins
(74) *Attorney, Agent, or Firm* — Oliff PLC

(57) ABSTRACT

A tape printing device includes a controller configured to control a feed motor such that, after printing is performed to n pieces of labels, when a label tape is cut between an n-th label and a (n+1)th label counted from a leading edge of the label tape in a first direction and the (n+1)th label is positioned at a print position at which printing is performed by a thermal head, the label tape is fed in a second direction until the (n+1)th label is displaced from the print position.

3 Claims, 12 Drawing Sheets

TAPE PRINTING DEVICE AND METHOD OF CONTROLLING TAPE PRINTING DEVICE

The present application is based on, and claims priority from JP Application Serial Number 2020-059826, filed Mar. 30, 2020, the disclosure of which is hereby incorporated by reference herein in its entirety.

BACKGROUND

1. Technical Field

The present disclosure relates to a tape printing device and a method of controlling the tape printing device.

2. Related Art

Label creating devices may use a thermal head to perform printing to labels on a label tape being fed, which includes a label mount and the labels attached on the label mount at predetermined intervals in the length direction of the label mount, for example, as in JP-A-2015-074096.

Such label creating devices may perform printing to n pieces of labels and cut the label tape between the n-th label and the (n+1)th label. After the cutting operation, until the next print operation is started, the (n+1)th label may be in the print position where the print operation is performed by the thermal head. In such a case, residual heat remaining in the thermal head may cause unnecessary printing to the (n+1)th label.

SUMMARY

According to an aspect of the present disclosure, a tape printing device includes a feed motor configured to serve as a drive source for feeding, in a first direction and a second direction that is opposite to the first direction, a label tape having a label mount and a plurality of labels attached on the label mount at predetermined intervals in a length direction of the label mount, a thermal head configured to perform printing to the labels in response to the feeding of the label tape in the first direction, a cutter disposed at a position in the first direction with respect to the thermal head, the cutter being configured to cut the label tape, and a controller configured to control the feed motor such that, after printing is performed to n pieces of labels, wherein n is an integer greater than or equal to one, when the label tape is cut between the n-th label and a (n+1)th label counted from a leading edge of the label tape in the first direction and the (n+1)th label is positioned at a print position at which printing is performed by the thermal head, the label tape is fed in the second direction until the (n+1)th label is displaced from the print position.

According to a second aspect of the present disclosure, a method of controlling a tape printing device including a feed motor configured to serve as a drive source for feeding, in a first direction and a second direction that is opposite to the first direction, a label tape having a label mount and a plurality of labels attached on the label mount at predetermined intervals in a length direction of the label mount, a thermal head configured to perform printing to the labels in response to the feeding of the label tape in the first direction, and a cutter disposed at a position in the first direction with respect to the thermal head, the cutter being configured to cut the label tape is provided. The method includes, after printing is performed to n pieces of labels, wherein n is an integer greater than or equal to one, cutting the label tape between the n-th label and a (n+1)th label counted from a leading edge of the label tape in the first direction, and when the label tape is cut and the (n+1)th label is positioned at a print position at which printing is performed by the thermal head, controlling the feed motor such that the label tape is fed in the second direction until the (n+1)th label is displaced from the print position.

DESCRIPTION OF EXEMPLARY EMBODIMENTS

Figure 1:
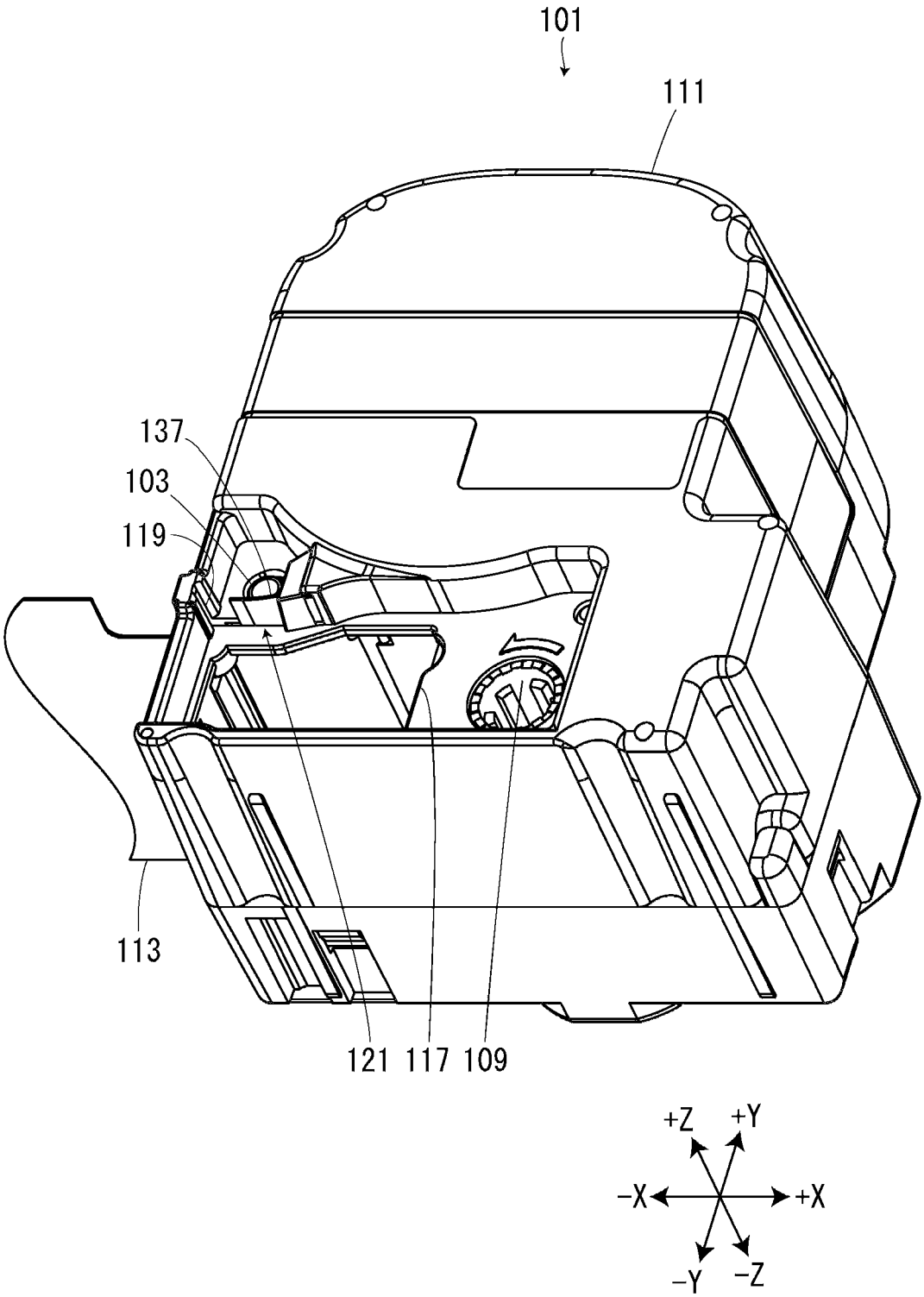
FIG. 1 is a perspective view illustrating a tape cartridge.

A tape printing device 1 according to an embodiment of a tape printing device will be described with reference to the attached drawings. The XYZ rectangular coordinate system in the drawings are merely for convenience, and does not limit the following embodiments.

Tape Cartridge

Figure 2:
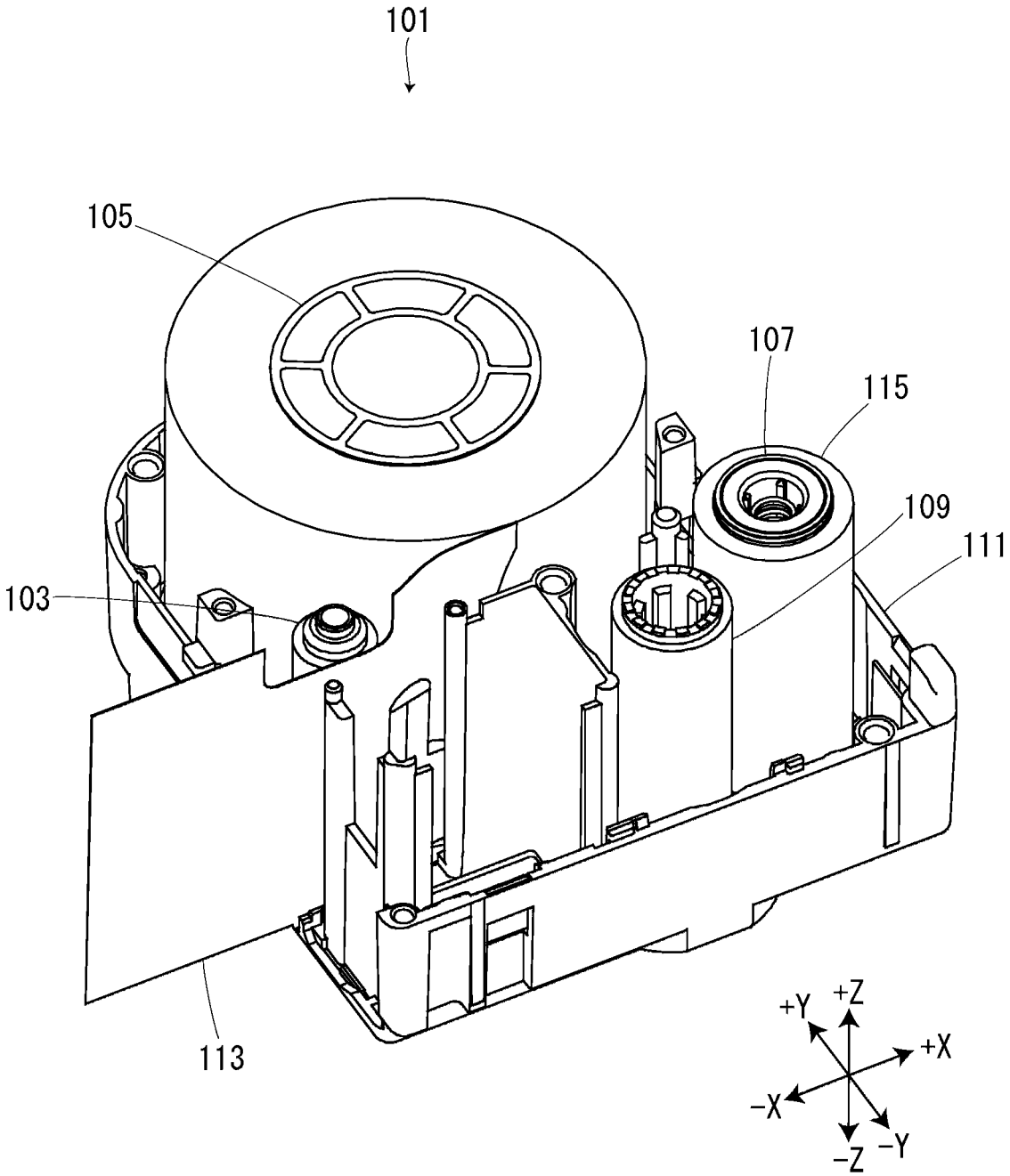
FIG. 2 is a perspective view illustrating a tape cartridge in which part of a cartridge case is omitted.

A tape cartridge 101 to be attached to the tape printing device 1 illustrated in FIG. 4 will be described with reference to FIG. 1 and FIG. 2. The tape cartridge 101 includes a platen roller 103, a tape core 105, a paying-out core 107, a winding core 109, and a cartridge case 111 that houses these components.

A label tape 113 is wound around the tape core 105. An ink ribbon 115 is wound around the paying-out core 107. The ink ribbon 115 that is fed from the paying-out core 107 is wound by the winding core 109. The platen roller 103 feeds the label tape 113 and the ink ribbon 115 while nipping the label tape 113 and the ink ribbon 115 with a thermal head 15 as illustrated in FIG. 4. The cartridge case 111 has a head insertion hole 117 that extends in the Z direction. A cartridge tape exit slot 119 is provided on a −X-direction surface of the cartridge case 111. From the cartridge tape exit slot 119, the label tape 113 that is fed from the tape core 105 is discharged. An exposure area 121 in which a detection convex portion 137 of the label tape 113 is exposed is provided on a +Z-direction surface of the cartridge case 111. The detection convex portion 137 will be described below.

Label Tape

Figure 3:
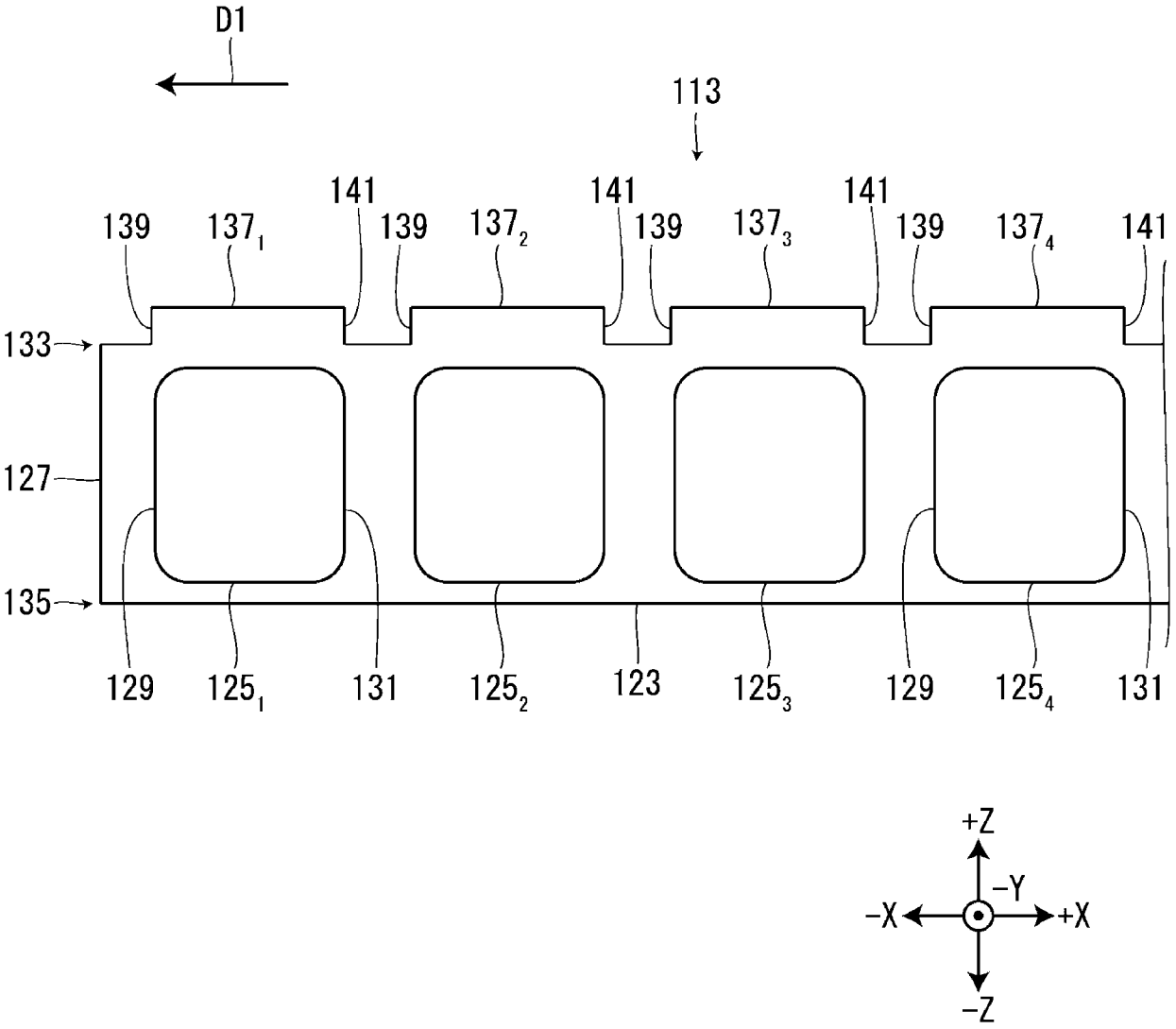
FIG. 3 illustrates a label tape.
Figure 9:
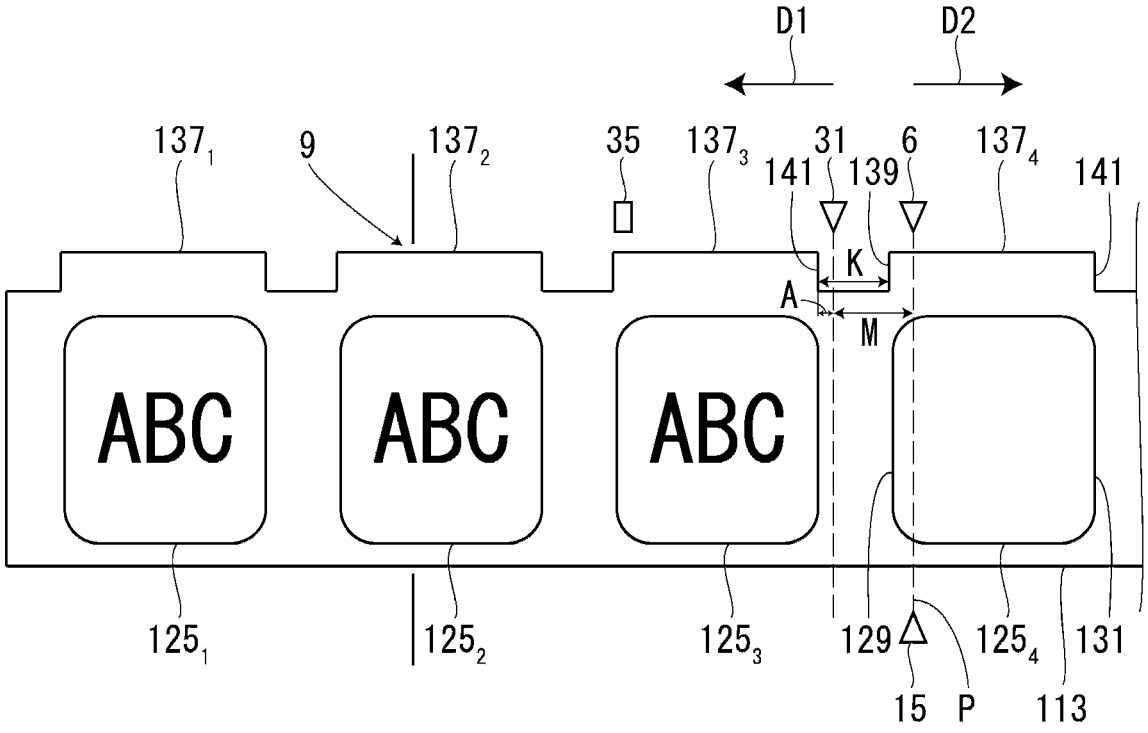
FIG. 9 illustrates a printing operation performed by the tape printing device following the operation in FIG. 8.

As illustrated in FIG. 3, the label tape 113 has a label mount 123 and a plurality of labels 125. On the label 125, a print image is to be printed by the tape printing device 1 as illustrated in FIG. 9. A plurality of labels 125 are attached on the label mount 123 at approximately equal intervals in the X direction, that is, in a length direction of the label mount 123. One of ends of each label 125 in the X direction is referred to as a first label end 129, which is the end in the −X direction and adjacent to a pay-out leading edge 127 of the label tape 113, and the other end of the label 125 is referred to as a second label end 131, which is the end in the +X direction and remote from the pay-out leading edge 127 of the label tape 113. The pay-out leading edge 127 of the label tape 113 means a leading edge of the label tape 113 in a first direction D1. The first direction D1 is a direction in which the label tape 113 is fed toward the devicejkhf tape exit slot 9 illustrated in FIG. 4 as will be described below. Although the shape of the label 125 is a rounded rectangle, the shape is not limited to the rounded rectangle, and may be any shape such as a circle, an oval, a polygon, or a combination of these shapes.

On the label mount 123, a plurality of labels 125 are releasably attached. The label mount 123 is a substantially band-shaped tape and has a first side 133 and a second side 135. The first side 133 is one side of the label mount 123 in the +Z direction, which is one side of the label mount 123 in the width direction, and the second side 135 is the other side of the label mount 123 in the −Z direction, which is the other side of the label mount 123 in the width direction. The first side 133 has a plurality of detection convex portions 137. The detection convex portion 137 is a portion of the first side 133 that partially protrudes in the width direction of the label mount 123. Each of the detection convex portions 137 has a substantially rectangular shape long in the length direction of the label tape 113. The detection convex portion 137 is detected by a sensor 6 (see FIG. 4), which will be described below.

The detection convex portions 137 are provided at approximately equal intervals in the length direction of the label mount 123. The detection convex portions 137 are provided for respective labels 125. An n-th detection convex portion 137 corresponds to an n-th label 125. Here, n is an integer of one or greater. Here, "-th" means a number counted from the leading edge of the label tape 113 in the first direction D1, that is, a number counted from the pay-out leading edge 127 of the label tape 113. In FIG. 3 and other drawings, the reference numeral of an n-th label 125 is denoted as "125*n*". Similarly, the reference numeral of an n-th detection convex portion 137 is denoted as "137*n*".

One of ends of each detection convex portion 137 in the length direction of the label tape 113 is referred to as a first detection target 139, which is the end in the −X direction and adjacent to the pay-out leading edge 127 of the label tape 113, and the other end of the detection convex portion 137 is referred to as a second detection target 141, which is the end in the +X direction and remote from the pay-out leading edge 127 of the label tape 113. The first detection target 139 and the second detection target 141 are provided in the label tape 113 for each label 125. The first detection target 139 is slightly adjacent to the −X side with respect to the first label end 129 of the corresponding label 125, for example, about several millimeters, whereas the second detection target 141 is provided at a substantially same position as the second label end 131 of the corresponding label 125 in the X direction.

Overview of Tape Printing Device

Figure 4:
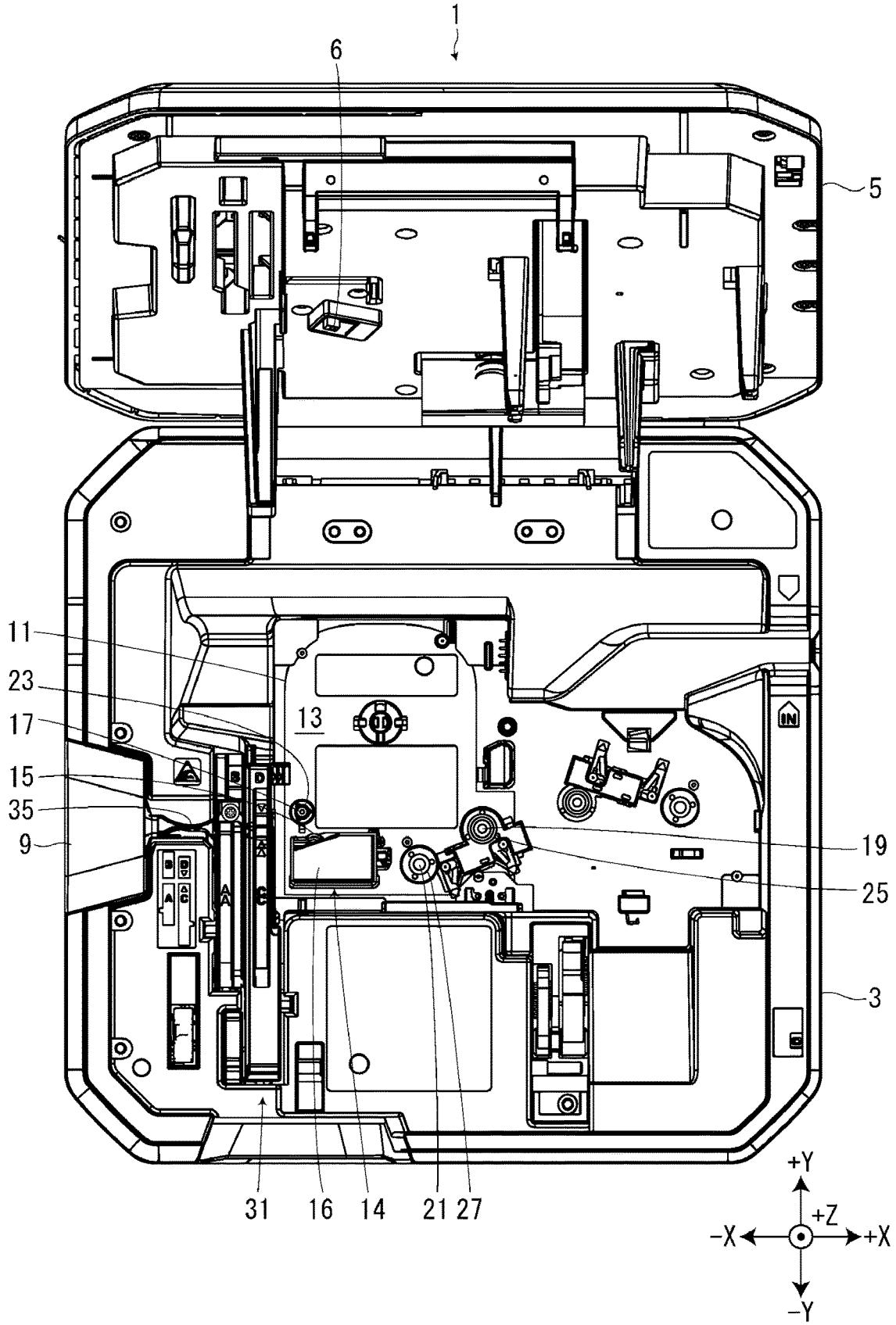
FIG. 4 illustrates a tape printing device viewed in a +Z direction.

As illustrated in FIG. 4, the tape printing device 1 includes a device case 3 and an attachment section cover 5. The device case 3 is a substantially rectangular parallelepiped. A cartridge mounting section 11 is provided on a +Z-direction surface of the device case 3. The cartridge mounting section 11 has a concave shape and its +Z side is open. The tape cartridge 101 is detachably attached to the cartridge mounting section 11.

Figure 6:
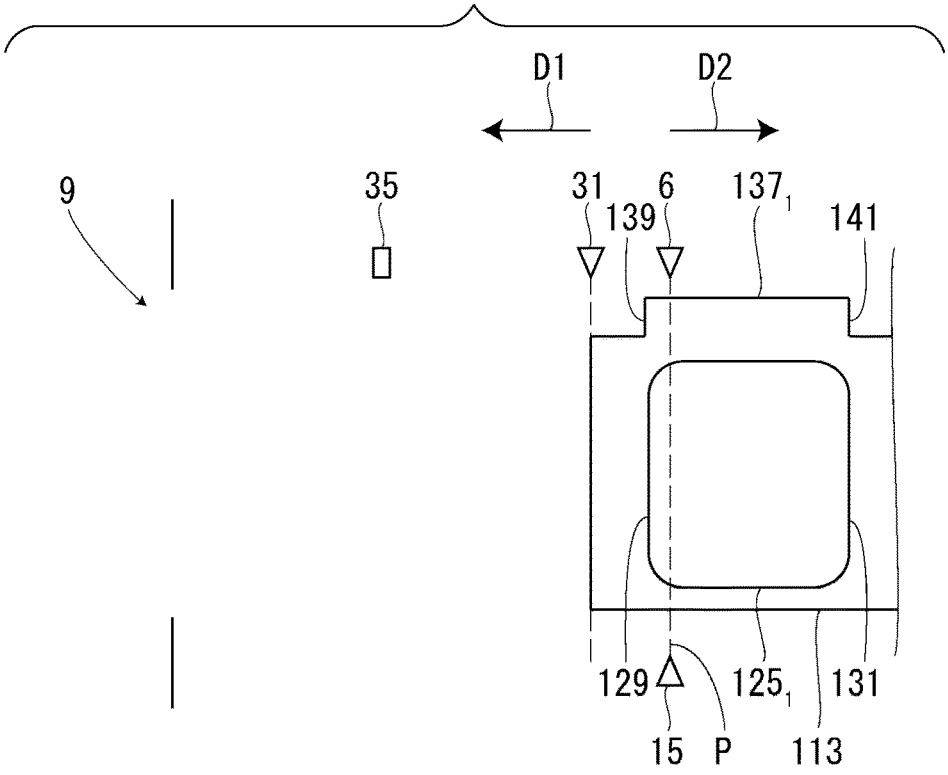
FIG. 6 illustrates a printing operation performed by a tape printing device.

The device tape exit slot 9 is provided in a −X surface of the device case 3. From the device tape exit slot 9, the label tape 113 that is fed from the tape cartridge 101, which is mounted in the cartridge mounting section 11, is discharged. The direction in which the label tape 113 is fed toward the device tape exit slot 9 in FIG. 6 is referred to as the first direction D1. The direction opposite to the first direction D1 in FIG. 6 is referred to as a second direction D2.

The attachment section cover 5 is rotatably attached to a +Y-direction end of the device case 3 and is used to open or close the cartridge mounting section 11. On an inner surface of the attachment section cover 5, the sensor 6 is disposed. The sensor 6 detects the detection convex portion 137 that is exposed from the exposure area 121 of the cartridge case 111 in a state in which the attachment section cover 5 is closed and the tape cartridge 101 is mounted in the cartridge mounting section 11. The sensor 6 may be, for example, a photointerrupter that includes a light emitting element and a light receiving element.

The sensor 6 detects the presence of the detection convex portion 137. Here, when the sensor 6 detects the "presence" of the detection convex portion 137, it means that the detection convex portion 137 is positioned between the light emitting element and the light receiving element of the sensor 6. Then, the sensor 6 outputs an output signal "1". On the other hand, when the sensor 6 detects the "absence" of the detection convex portion 137, it means that the detection convex portion 137 is not positioned between the light emitting element and the light receiving element of the sensor 6, that is, the portion between the detection convex portions 137 is positioned between the light emitting element and the light receiving element. Then, the sensor 6 outputs an output signal "0".

The sensor 6 also detects the first detection target 139 and the second detection target 141. Here, when the sensor 6 detects the first detection target 139, it means that the first detection target 139 is positioned between the light emitting element and the light receiving element of the sensor 6. When the label tape 113 is fed in the first direction D1, the output signal from the sensor 6 is changed from "0" to "1", whereas when the label tape 113 is fed in the second direction D2, the output signal from the sensor 6 is changed from "1" to "0". When the sensor 6 detects the second detection target 141, it means that the second detection target 141 is positioned between the light emitting element and the light receiving element of the sensor 6. When the label tape 113 is fed in the first direction D1, the output signal from the sensor 6 is changed from "1" to "0", whereas when the label tape 113 is fed in the second direction D2, the output signal from the sensor 6 is changed from "0" to "1". It should be noted that "1" and "0" of the signal that is output by the sensor 6 may be reversed.

A head section 14 is disposed on a mounting bottom surface 13, which is a bottom surface of the cartridge mounting section 11. The head section 14 includes the thermal head 15 and a head cover 16. The thermal head 15 includes a heating element (not illustrated). The head cover 16 covers part of the thermal head 15. A platen shaft 17, a paying-out shaft 19, and a winding shaft 21 are provided to the mounting bottom surface 13.

The platen shaft 17, the paying-out shaft 19, and the winding shaft 21 rotatably support a platen rotator 23, a paying-out rotator 25, and a winding rotator 27 respectively. When the tape cartridge 101 is mounted in the cartridge mounting section 11, the platen rotator 23, the paying-out rotator 25, and the winding rotator 27 are inserted into the platen roller 103, the paying-out core 107, and the winding core 109 respectively, thereby engaging with the platen roller 103, the paying-out core 107, and the winding core 109 respectively. When the tape cartridge 101 is mounted in the cartridge mounting section 11, the head section 14 is inserted into the head insertion hole 117.

After the tape cartridge 101 is mounted in the cartridge mounting section 11 and the attachment section cover 5 is closed, the thermal head 15 is moved toward the platen shaft 17 by a head moving mechanism (not illustrated). By the operation, the label tape 113 and the ink ribbon 115 are nipped between the thermal head 15 and the platen roller 103.

In this state, when a feed motor 29 (see FIG. 5) is rotated in a first rotation direction, the rotation of the feed motor 29 is transmitted via a gear train (not illustrated) to the platen rotator 23 and the winding rotator 27 to rotate the platen roller 103 and the winding core 109. By the operation, the label tape 113 is fed in the first direction D1 and the ink ribbon 115 is fed from the paying-out core 107 toward the winding core 109 and wound by the winding core 109.

On the other hand, when the feed motor 29 is rotated in a second rotation direction that is opposite to the first rotation direction, the rotation of the feed motor 29 is transmitted via the gear train to the platen rotator 23 and the paying-out rotator 25 to rotate the platen roller 103 and the paying-out core 107 respectively. By the operation, the label tape 113 is fed in the second direction D2 and the ink ribbon 115 is reversely fed from the winding core 109 toward the paying-out core 107 and rewound by the paying-out core 107.

A cutter 31 is disposed between the cartridge mounting section 11 and the device tape exit slot 9. The cutter 31 cuts the label tape 113. The cutter 31 is driven by a cutter motor 33 illustrated in FIG. 5 to perform a cutting operation.

A discharging roller 35 is disposed between the cutter 31 and the device tape exit slot 9. The discharging roller 35 discharges the label tape 113 that has been cut off by the cutter 31 toward the device tape exit slot 9.

The tape printing device 1 performs a printing operation in accordance with print data generated by inputting characters or the like in the tape printing device 1 or print data received from an external device such as a personal computer. The tape printing device 1, accordingly, prints a print image in accordance with print data onto the label 125 by heat generated in the thermal head 15 while feeding the label tape 113 and the ink ribbon 115 by the platen roller 103 by rotating the feed motor 29 in the first rotation direction. After the completion of the printing, the tape printing device 1 cuts off the label tape 113 between the printed label 125 and the unprinted label 125 with the cutter 31. The tape printing device 1 discharges the separated label tape 113 with the discharging roller 35 from the device tape exit slot 9.

Controller

Figure 5:
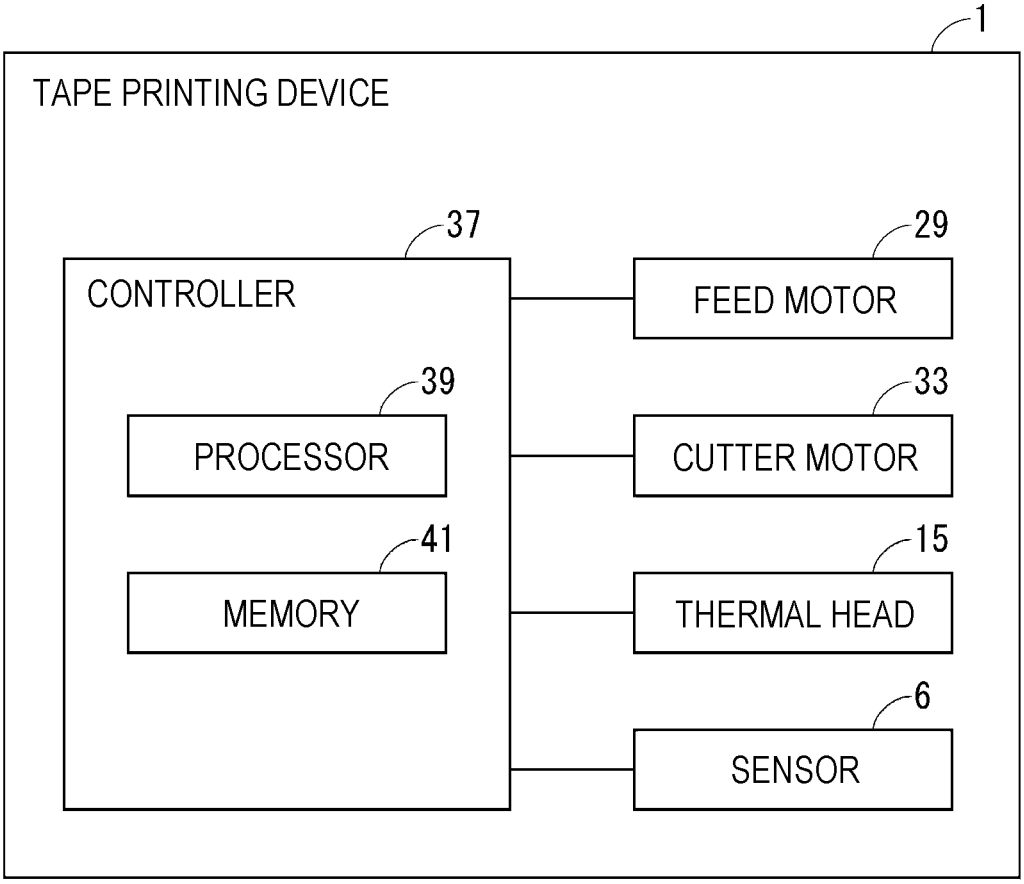
FIG. 5 is a block diagram illustrating a control configuration of a tape printing device.

As illustrated in FIG. 5, the tape printing device 1 includes a controller 37. The controller 37 controls the feed motor 29, the cutter motor 33, and the thermal head 15. For example, the controller 37 controls the number of pulses applied to the feed motor 29, which is a stepping motor, to control the amount of feed of the label tape 113. The controller 37 receives an output signal from the sensor 6.

The controller 37 includes a processor 39 and a memory 41. The processor 39 performs various types of control processes by executing a program stored in the memory 41. The processor 39 is, for example, at least one central processing unit (CPU). The processor 39 may be a hardware circuit such as an application specific integrated circuit (ASIC) or may be a combination of at least one CPU and a hardware circuit such as an ASIC. The memory 41 includes, for example, a read-only memory (ROM), a random access memory (RAM), and a character generator ROM (CGROM).

Printing Operation

With reference to FIG. 6 to FIG. 12, the printing operation to be performed by the tape printing device 1 will be described. Here, as an example, printing is performed to three labels 125 in a single printing operation; however, the number of the labels 125 to be printed in a single printing operation may be set to any number of the labels 125 by the user and the number is not limited to a particular number.

As illustrated in FIG. 6, in the first direction D1, in near order to the device tape exit slot 9, the discharging roller 35, the cutter 31, and the sensor 6 are disposed in this order. The thermal head 15 is disposed at a substantially same position as the sensor 6 in the first direction D1.

The tape printing device 1 starts a printing operation in accordance with an instruction for executing printing from the user. When the tape printing device 1 receives the printing execution instruction from the user, as illustrated in FIG. 6, depending on the feeding condition of the label tape 113, the first label end 129 of the first label 125 is positioned at a position in the first direction D1 beyond a print position P at which printing is performed by the thermal head 15. If the label tape 113 is fed in the first direction D1 in this state, the thermal head 15 cannot print from the first label end 129 of the first label 125. The print position P at which printing is performed by the thermal head 15 according to the embodiment is a position at which the label tape 113 is nipped between the thermal head 15 and the platen roller 103 in the first direction D1.

Figure 7:
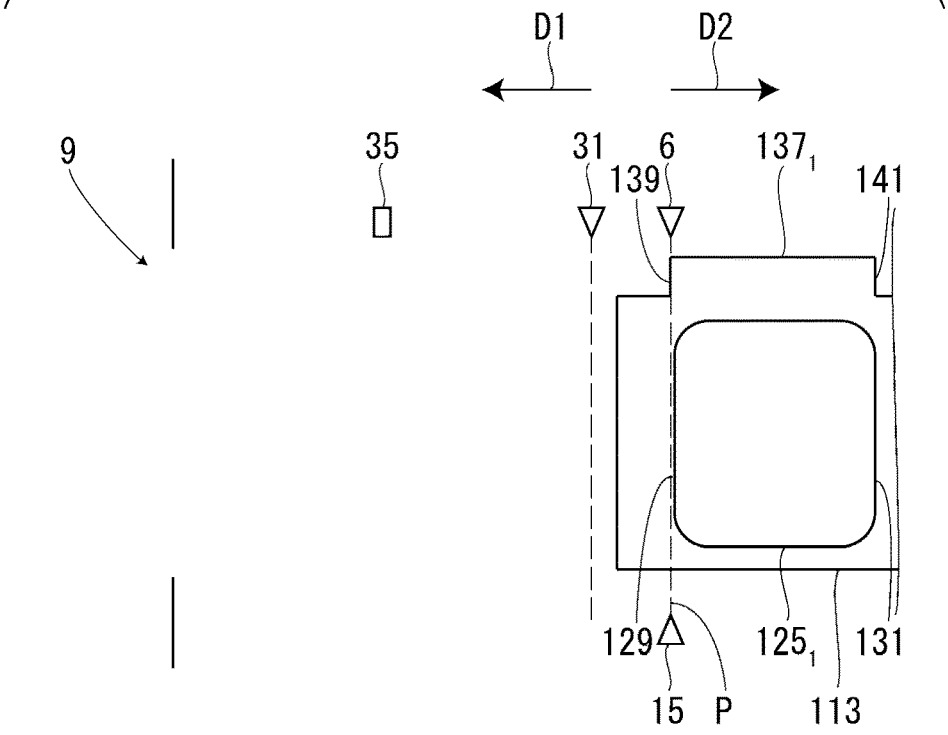
FIG. 7 illustrates a printing operation performed by the tape printing device following the operation in FIG. 6.

In the state in which the first label end 129 of the first label 125 is positioned at the position in the first direction D1 beyond the print position P, the first detection convex portion 137 is positioned at a position corresponding to the sensor 6. In such a case, at the time the tape printing device 1 receives an instruction for executing printing from the user, when the sensor 6 detects the "presence" of the detection convex portion 137, as illustrated in FIG. 7, the tape printing device 1 feeds the label tape 113 in the second direction D2 until the sensor 6 detects the first detection target 139 of the first detection convex portion 137. By the operation, the first label end 129 of the first label 125 is positioned at the position in the second direction D2 with respect to the print position P. Accordingly, the thermal head 15 can print from the first label end 129 of the first label 125.

Figure 8:
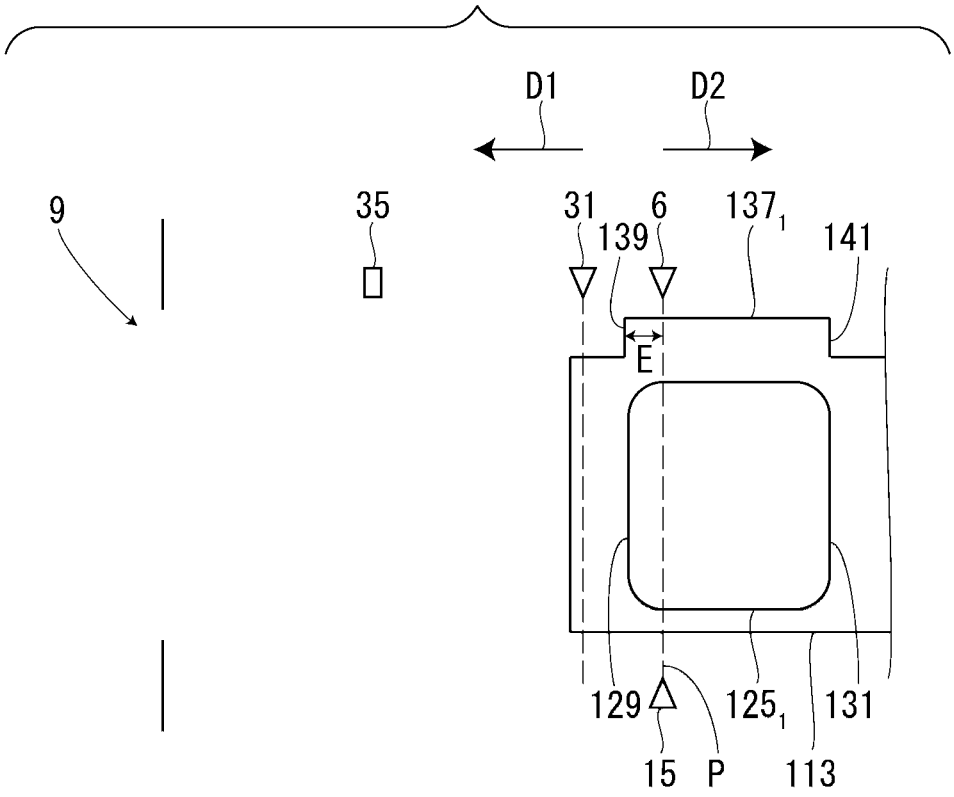
FIG. 8 illustrates a printing operation performed by the tape printing device following the operation in FIG. 7.

The tape printing device 1 switches the direction of feeding the label tape 113 from the second direction D2 to the first direction D1 as illustrated in FIG. 8 and feeds the label tape 113 in the first direction D1 by a distance E based on a predetermined margin from the point at which the sensor 6 has detected the first detection target 139 of the first detection convex portion 137. The tape printing device 1 starts printing to the first label 125 by using the thermal head 15 from the point to which the label tape 113 has been fed by the distance E based on the margin. The tape printing device 1 performs printing in the same manner to the second label 125 and the third label 125 based on the detection of the first detection target 139 of the second detection convex portion 137 and the first detection target 139 of the third detection convex portion 137 respectively.

After the completion of printing to the last label 125 to be printed, that is, the third label 125, the tape printing device 1 feeds the label tape 113 in the first direction D1 to cut the label tape 113 by the cutter 31 between the third label 125 and the fourth label 125 as illustrated in FIG. 9. More specifically, after the tape printing device 1 feeds the label tape 113 in the first direction D1 until the sensor 6 detects the second detection target 141 of the third detection convex portion 137, the tape printing device 1 feeds the label tape 113 in the first direction D1 by a distance obtained by adding a distance A to a head-cutter distance M. The head-cutter distance M means a distance between the thermal head 15 and the cutter 31 in the first direction D1. The distance A is a predetermined distance less than a detection target-to-detection target dimension K. Here, the detection target-to-detection target dimension K is a distance between the second detection target 141 of an n-th detection convex portion 137 and the first detection target 139 of a (n+1)th detection convex portion 137.

Figure 10:
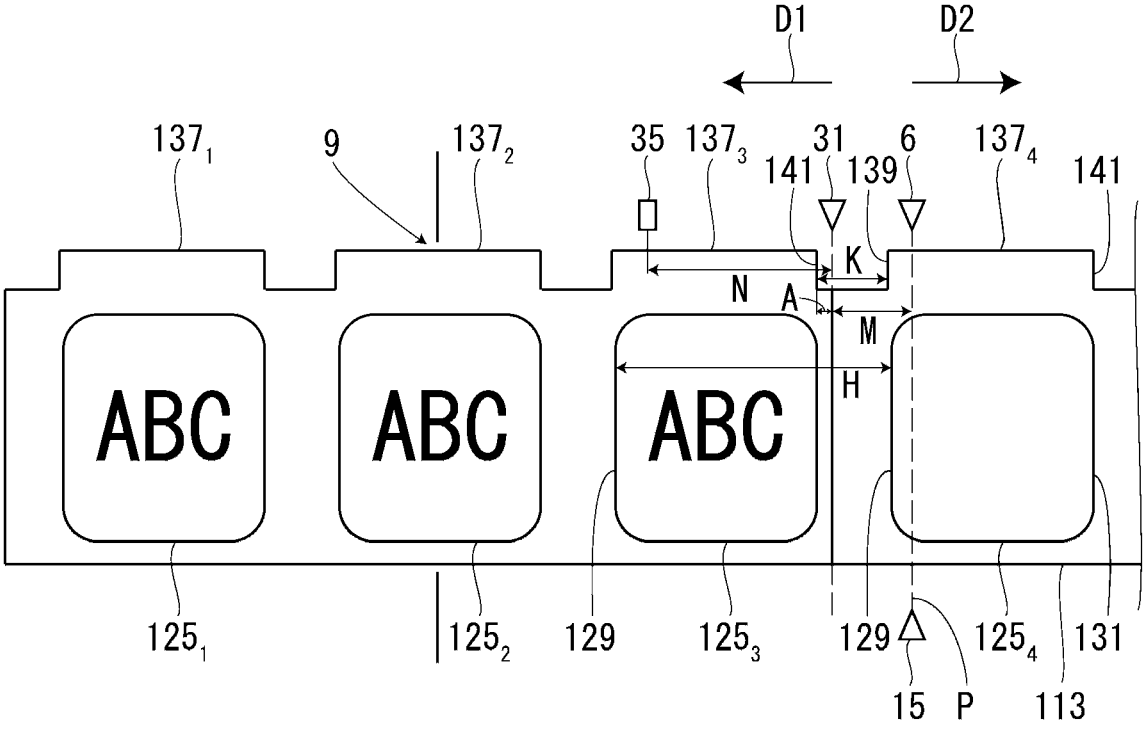
FIG. 10 illustrates a printing operation performed by the tape printing device following the operation in FIG. 9.

After the tape printing device 1 feeds the label tape 113 in the first direction D1 by the distance obtained by adding the distance A to the head-cutter distance M, as illustrated in FIG. 10, the cutter 31 cuts the label tape 113 between the third label 125 and the fourth label 125.

As illustrated in FIG. 10, when the label tape 113 is cut by the cutter 31, the fourth label 125 is positioned at the print position P at which printing is performed by the thermal head 15. Accordingly, unlike this embodiment, if the label tape 113 is not fed after the label tape 113 is cut by the cutter 31 and before the next printing operation is started, residual heat remaining in the thermal head 15 may cause unnecessary printing to the fourth label 125. Here, "the label 125 is positioned at the print position P at which printing is performed by the thermal head 15" means that, in this embodiment, the label 125 is nipped between the thermal head 15 and the platen roller 103.

Figure 11:
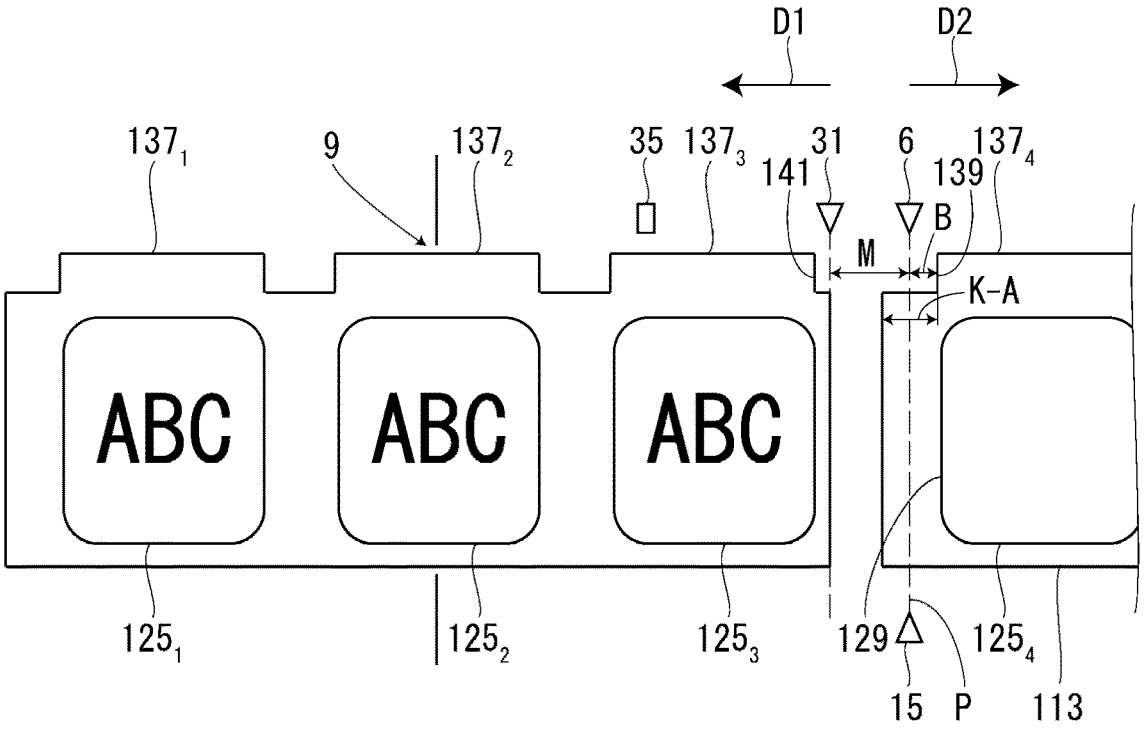
FIG. 11 illustrates a printing operation performed by the tape printing device following the operation in FIG. 10.

The tape printing device 1 according to the embodiment, however, after the cutter 31 cuts the label tape 113, switches the direction of feeding the label tape 113 from the first direction D1 to the second direction D2 to feed the label tape 113 in the second direction D2 until the sensor 6 detects the first detection target 139 of the fourth detection convex portion 137 as illustrated in FIG. 11. Furthermore, after the detection of the first detection target 139 of the fourth detection convex portion 137, the tape printing device 1 feeds the label tape 113 in the second direction D2 by a distance B. By the operation, after the label tape 113 is cut between the third label 125 and the fourth label 125, until the next printing is started, the fourth label 125 is displaced from the print position P. Accordingly, it can be prevented that residual heat remaining in the thermal head 15 causes unnecessary printing to the fourth label 125. The distance B is a predetermined distance less than a distance obtained by subtracting the distance A from the detection target-to-detection target dimension K.

Figure 12:
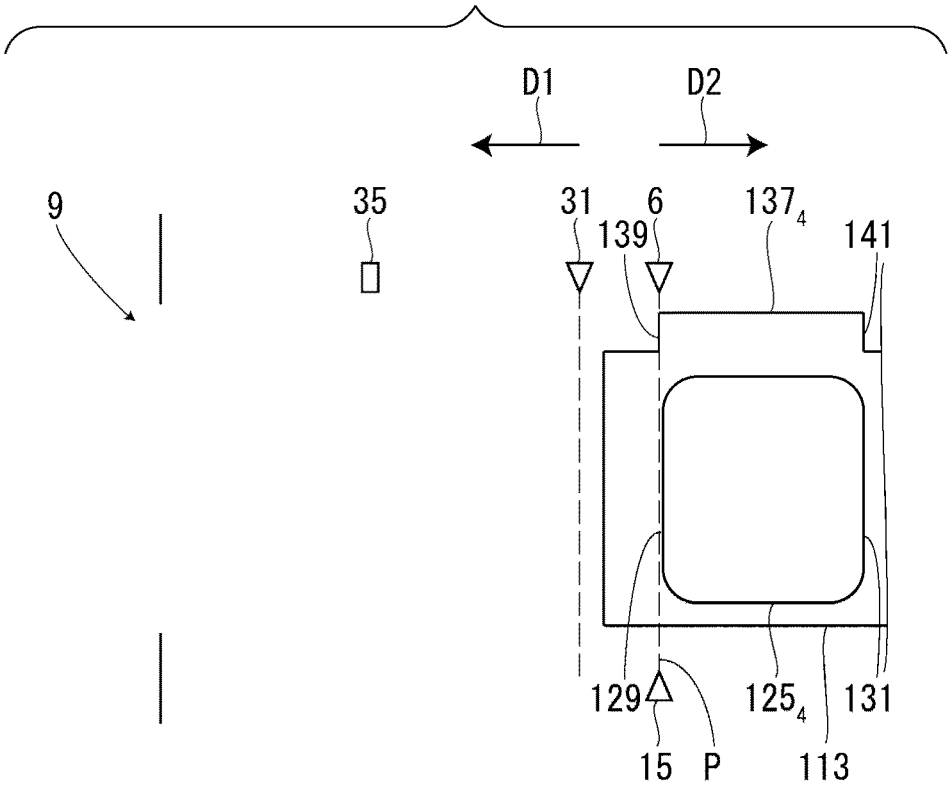
FIG. 12 illustrates a printing operation performed by the tape printing device following the operation in FIG. 11.

As described above, after the sensor 6 detects the first detection target 139 of the fourth detection convex portion 137, the tape printing device 1 further feeds the label tape 113 in the second direction D2 by the distance B, and thus the first detection target 139 of the fourth detection convex portion 137 is positioned at the position in the second direction D2 direction with respect to the sensor 6. Accordingly, the tape printing device 1 feeds the label tape 113 in the first direction D1 at the start of the next printing operation as illustrated in FIG. 12 such that the first detection target 139 of the fourth detection convex portion 137, that is, the first detection target 139 of the first detection convex portion 137 in the next printing operation can be detected. In response to the detection of the first detection target 139 of the fourth detection convex portion 137, similarly to the above, the tape printing device 1 performs printing to the fourth label 125, that is, the first detection convex portion 137 in the next printing operation.

In a case in which the detection target-to-detection target dimension K is less than the distance that is obtained by adding the distance A to the head-cutter distance M as illustrated in FIG. 9, when the label tape 113 is cut by the cutter 31 between an n-th label 125 and a (n+1)th label 125, the n-th label 125 is positioned at the print position P. Accordingly, this embodiment is particularly advantageous when the detection target-to-detection target dimension K is less than the distance obtained by adding the distance A to the head-cutter distance M. The tape printing device 1 according to the embodiment, accordingly, enables the detection target-to-detection target dimension K of the label tape 113 to be shorter than the distance obtained by adding the distance A to the head-cutter distance M, or less than the head-cutter distance M. Consequently, the number of labels 125 per unit length in the label tape 113 can be increased, and the number of the labels 125 per a single tape cartridge 101 can be increased. The detection target-to-detection target dimension K is determined in consideration of the layout of the components in the tape printing device 1, the accuracy of the sensor 6, and the like.

A label pitch H, that is, the space between the first label end 129 of an n-th label 125 and the first label end 129 of a (n+1)th label 125 may be greater than a cutter-roller distance N that is a distance between the cutter 31 and the discharging roller 35 as illustrated in FIG. 10. Such a label pitch H enables the label tape 113 to be cut by the cutter 31 in a state in which the label tape 113 is nipped by the discharging roller 35, thereby reducing or preventing the separated label tape 113 from causing a paper jam between the cutter 31 and the discharging roller 35.

Print Control Processing

Figure 13:
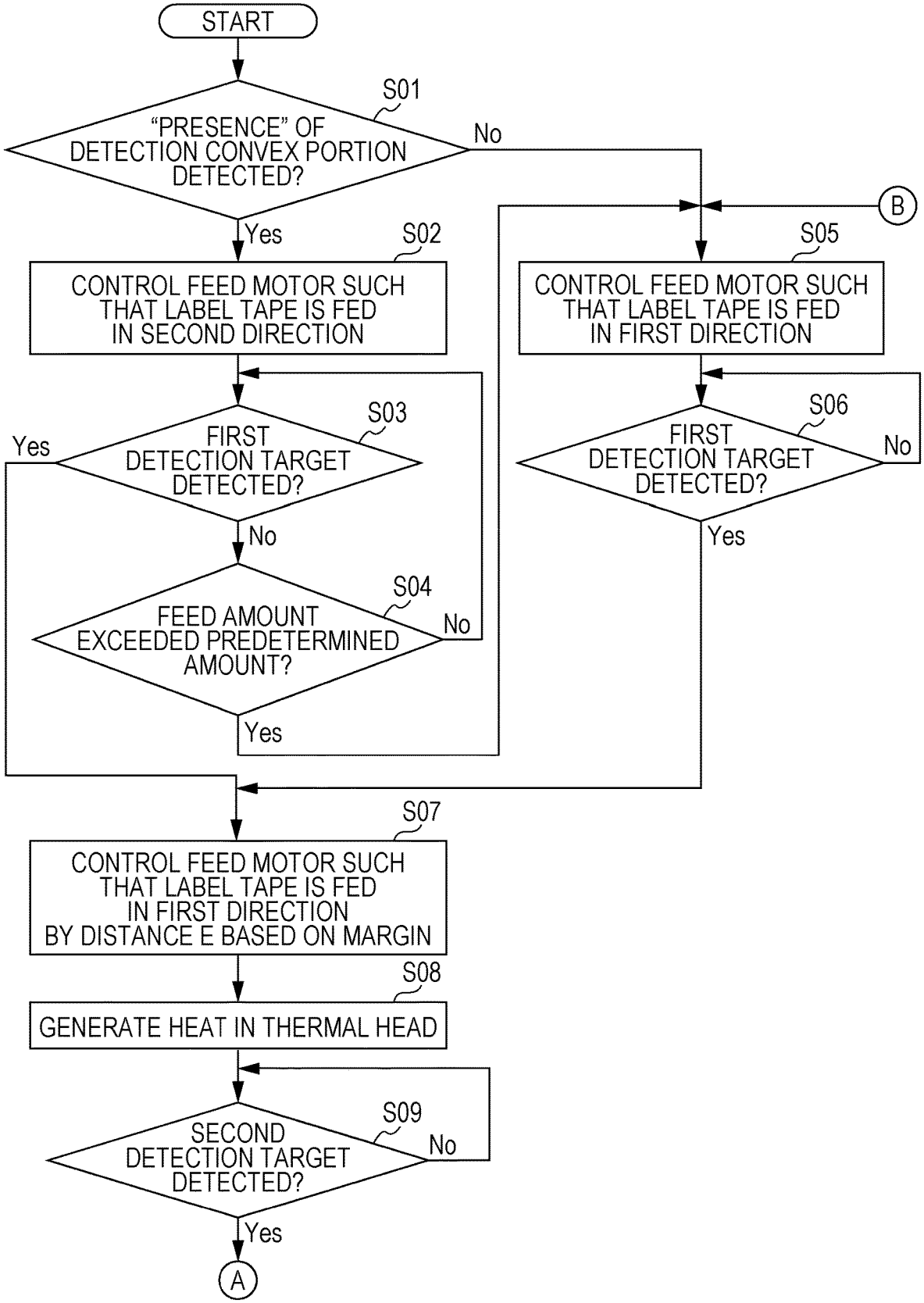
FIG. 13 is a flowchart illustrating print control processing performed by a controller in printing operations.
Figure 14:
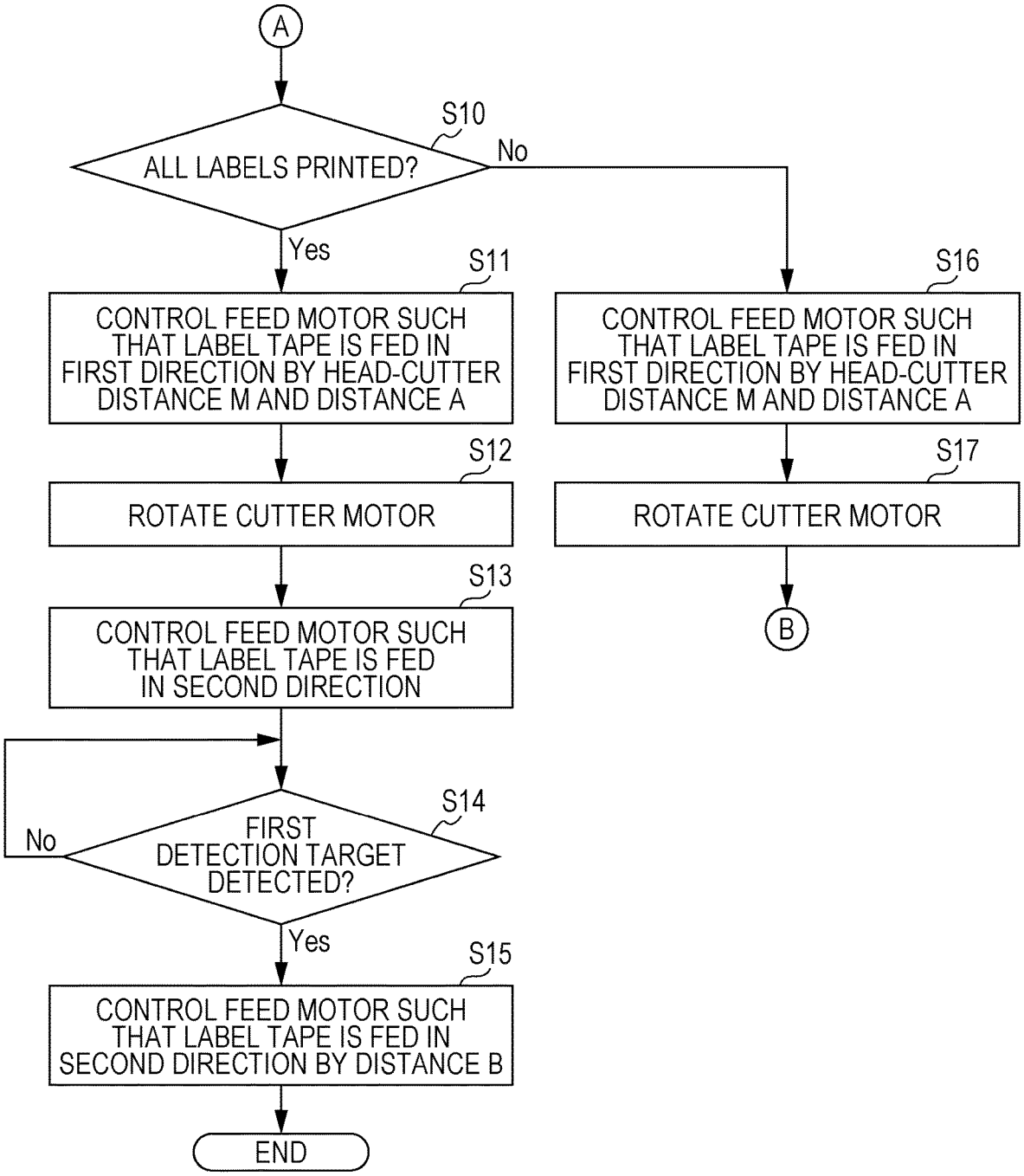
FIG. 14 is a flowchart illustrating print control processing performed by the controller in printing operations following the processing in FIG. 13.

With reference to FIG. 13 and FIG. 14, the print control processing performed by the controller 37 in the above-described printing operations will be described. The controller 37 starts the print control processing in response to receiving an instruction for executing printing from the user.

In step S01, the controller 37 determines, based on an output signal from the sensor 6, whether the sensor 6 detects the "presence" of the detection convex portion 137. When the controller 37 determines that the sensor 6 detects the "presence" of the detection convex portion 137, the processing proceeds to step S02. The "presence" of the detection convex portion 137 may be detected, for example, after the cutting of the label tape 113 and the feeding of the label tape 113 in the second direction D2 illustrated in FIG. 11 are normally performed and the label tape 113 is pulled out of the cartridge tape exit slot 119 by the user, or printing is started from a state in which previous printing process is interrupted due to a power shutdown during the printing.

In step S02, the controller 37 controls the feed motor 29 such that the label tape 113 is fed in the second direction D2 as illustrated in FIG. 7.

In step S03, the controller 37 determines, based on an output signal from the sensor 6, whether the sensor 6 detects the first detection target 139. When the controller 37 determines that the sensor 6 detects the first detection target 139, the processing proceeds to step S07. When the controller 37 determines that the sensor 6 does not detect the first detection target 139, the processing proceeds to step S04.

In step S04, the controller 37 determines whether the amount of feed of the label tape 113 in the second direction D2 from the start of the feeding in step S02 exceeds a predetermined amount. When the controller 37 determines that the amount of feed of the label tape 113 in the second direction D2 does not exceed the predetermined amount, the processing returns to step S03. When the controller 37 determines that the amount of feed of the label tape 113 in the second direction D2 exceeds the predetermined amount, the processing proceeds to step S05. In this processing, printing is not performed to the first label 125 and printing starts from the second label 125. By the processing, the sensor 6 does not detect the first detection target 139 and the label tape 113 is continuously fed in the second direction D2, and the pay-out leading edge 127 is drawn into the cartridge case 111, and thus the occurrence of tape jams, that is, jamming can be prevented or reduced. When the sensor 6 does not detect the first detection target 139, for example, the detection convex portion 137 may have some defect due to some trouble during manufacturing or the detection convex portion 137 may be bent.

In step S01, when the controller 37 determines that the sensor 6 does not detect the "presence" of the detection convex portion 137, that is, detects the "absence" of the detection convex portion 137, the processing proceeds to step S05. When the process of cutting the label tape 113 and the process of feeding the label tape 113 in the second direction D2 illustrated in FIG. 11 are normally performed and a printing operation is started in this state, the "absence" of the detection convex portion 137 is detected.

In step S05, the controller 37 controls the feed motor 29 such that the label tape 113 is fed in the first direction D1.

In step S06, the controller 37 determines, based on an output signal from the sensor 6, whether the sensor 6 detects the first detection target 139. When the controller 37 determines that the sensor 6 detects the first detection target 139, the processing proceeds to step S07. When the controller 37 determines that the sensor 6 does not detect the first detection target 139, the processing in step S06 is repeated until the controller 37 determines that the sensor 6 detects the first detection target 139.

In step S07, after the sensor 6 detects the first detection target 139 as illustrated in FIG. 8, the controller 37 controls the feed motor 29 such that the label tape 113 is fed in the first direction D1 by the distance E based on the predetermined margin.

In step S08, after the sensor 6 detects that the first detection target 139, in response to the label tape 113 being fed in the first direction D1 by the distance E based on the predetermined margin, the controller 37 allows the thermal head 15 to generate heat. By the processing, a print image is formed on the label 125.

In step S09, the controller 37 determines, based on an output signal from the sensor 6, whether the sensor 6 detects the second detection target 141. When the controller 37 determines that the sensor 6 detects the second detection target 141, the processing proceeds to step S10. When the controller 37 determines that the sensor 6 does not detect the second detection target 141, the processing in step S09 is repeated until the controller 37 determines that the sensor 6 detects the second detection target 141.

In step S10, the controller 37 determines whether all labels 125 to be printed in a single printing operation are printed. When the controller 37 determines that all labels 125 to be printed in a single printing operation are printed, the processing proceeds to step S11.

In step S11, after the sensor 6 detects the second detection target 141 as illustrated in FIG. 9, the controller 37 controls the feed motor 29 such that the label tape 113 is fed in the first direction D1 by the distance obtained by adding the distance A to the head-cutter distance M.

In step S12, after the sensor 6 detects the second detection target 141 as illustrated in FIG. 10 and the label tape 113 is fed in the first direction D1 by the distance obtained by adding the distance A to the head-cutter distance M, the controller 37 allow the cutter motor 33 to rotate. By the processing, the label tape 113 is cut. In this processing, the unprinted label 125 is positioned at the print position P.

In step S13, the controller 37 controls the feed motor 29 such that the label tape 113 is fed in the second direction D2. By the operation, the unprinted label 125 is displaced from the print position P.

In step S14, the controller 37 determines, based on an output signal from the sensor 6, whether the sensor 6 detects the first detection target 139. When the controller 37 determines that the sensor 6 detects the first detection target 139, the processing proceeds to step S14. When the controller 37 determines that the sensor 6 does not detect the first detection target 139, the processing in step S14 is repeated until the controller 37 determines that the sensor 6 detects the first detection target 139.

In step S15, after the sensor 6 detects the first detection target 139 as illustrated in FIG. 11, the controller 37 controls the feed motor 29 such that the label tape 113 is fed in the second direction D2 by the distance B. As a result of the operation, the position of the sensor 6 is in the first direction D1 with respect to the first detection target 139 of the detection convex portion 137.

In step S10, when the controller 37 determines that not all labels 125 to be printed in a single printing operation are printed, the processing proceeds to step S16.

In step S16, similarly to step S11, after the sensor 6 detects the second detection target 141, the controller 37 controls the feed motor 29 such that the label tape 113 is fed in the first direction D1 by the distance obtained by adding the distance A to the head-cutter distance M.

In step S17, similarly to step S12, after the sensor 6 detects the second detection target 141 and the label tape 113 is fed in the first direction D1 by the distance obtained by adding the distance A to the head-cutter distance M, the controller 37 allow the cutter motor 33 to rotate. By the processing, the label tape 113 is cut. Then, the controller 37 returns to step S05. It should be noted that the controller 37 may skip step S16 and step S17 and return to step S04. In such a case, the label tape 113 is not cut into individual labels 125, and a plurality of printed labels 125 is produced as a series of printed labels 125 on the label mount 123.

Other Modifications

It is to be understood that the present disclosure is not limited to the above-described embodiment, various modifications can be made without departing from the scope of the disclosure. For example, in addition to the above-described embodiment, the embodiment may be modified as described below. Furthermore, the above-described embodiment and modifications may be combined with each other.

Figure 15:
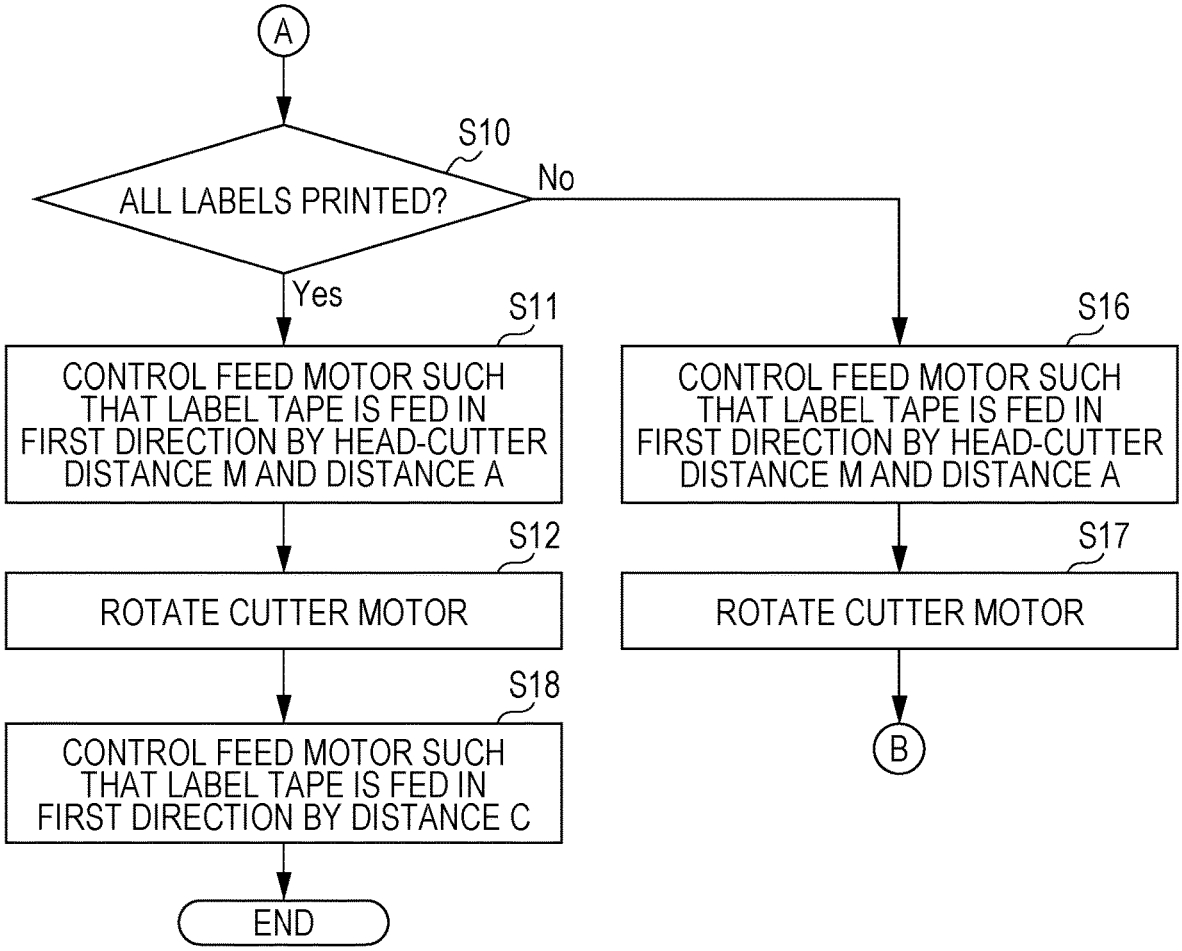
FIG. 15 is a flowchart illustrating print control processing performed by the controller in printing operations according to a modification.

The controller 37 may perform the processing in step S18 as illustrated in FIG. 15 instead of step S13 or step S15 illustrated in FIG. 14. In other words, after the controller 37 performs step S12, in step S18, the controller 37 may control the feed motor 29 such that the label tape 113 is fed in the second direction D2 by a distance C. Here, the distance C is a distance obtained based on the detection target-to-detection target dimension K, and more specifically, given by the following equation (1):

$$C=M-(K-A)+B \quad (1), \text{ wherein}$$

C: distance C;
M: head-cutter distance;
K: detection target-to-detection target dimension;
A: distance A; and
B: distance B.

In equation (1), "M−(K−A)" according to the embodiment corresponds to an amount of feed of the label tape 113 in the second direction D2 from the time the label tape 113 is cut between an n-th label 125 and a (n+1)th label 125 to the time the first detection target 139 of the (n+1)th detection convex portion 137 is detected as illustrated in FIG. 10.

The controller 37 may obtain the detection target-to-detection target dimension K, for example, by reading information about the detection target-to-detection target dimension K from a storage that is provided in the tape cartridge 101, or based on a value that is input in the tape printing device 1 by the user.

The controller 37 may determine, after performing step S12, whether the sensor 6 detects the "presence" of the detection convex portion 137. When the controller 37 determines that the sensor 6 detects the "presence" of the detection convex portion 137, the (n+1)th label 125 is positioned at the print position P when the label tape 113 is cut, and then the controller 37 performs each step after step S13. When the controller 37 determines that the sensor 6 does not detect the "presence" of the detection convex portion 137, the (n+1)th label 125 is displaced from the print position P when the label tape 113 is cut, and then the controller 37 ends the print control processing without performing each step after step S13. By the processing, for example, when the (n+1)th label 125 is displaced from the print position P when the label tape 113 is cut because the detection target-to-detection target dimension K of the label tape 113 is large, the print control processing can be ended without unnecessarily feeding the label tape 113 in the second direction D2.

Supplementary Notes

Hereinafter, supplementary notes of the tape printing device and the method of controlling the tape printing device will be described. A tape printing device includes a feed motor configured to serve as a drive source for feeding, in a first direction and a second direction that is opposite to the first direction, a label tape having a label mount and a plurality of labels attached on the label mount at predetermined intervals in a length direction of the label mount, a thermal head configured to perform printing to the labels in response to the feeding of the label tape in the first direction, a cutter disposed at a position in the first direction with respect to the thermal head, the cutter being configured to cut the label tape, and a controller configured to control the feed motor such that, after printing is performed to n pieces of labels, wherein n is an integer greater than or equal to one, when the label tape is cut between the n-th label and a (n+1)th label counted from a leading edge of the label tape in the first direction and the (n+1)th label is positioned at a print position at which printing is performed by the thermal head, the label tape is fed in the second direction until the (n+1)th label is displaced from the print position.

In the tape printing device, after the label tape is cut between the n-th label and a (n+1)th label, until the next printing is started, the (n+1)th label is displaced from the print position at which printing is performed by the thermal head. Accordingly, it can be prevented that residual heat remaining in the thermal head causes unnecessary printing to the (n+1)th label.

The tape printing device may further include a sensor configured to detect a first detection target provided in the label tape for each label, in which the controller controls the thermal head such that, in feeding the label tape in the first direction, after the detection of the first detection target, printing to the label corresponding to the detected first detection target is started, and the controller controls the feed motor such that, when the label tape is fed in the second direction until the (n+1)th label is displaced from the print position, after the first detection target corresponding to the (n+1)th label is detected, the label tape is fed in the second direction by a first distance.

In the tape printing device, the feeding of the label tape is stopped in a state in which the first detection target corresponding to the (n+1)th label is positioned at a position in the second direction with respect to the sensor. Accordingly, in the next printing operation, when the label tape is fed in the first direction, the sensor can detect the first detection target that corresponds to the (n+1)th label. It should be noted that the distance B is an example "first distance".

The tape printing device may further include a sensor configured to detect a first detection target and a second detection target provided in the label tape for each label, in which the controller controls the thermal head such that, in feeding the label tape in the first direction, after the detection of the first detection target, printing to the label corresponding to the detected first detection target is started, and the controller controls the cutter such that, after the second detection target corresponding to the n-th label is detected, the label tape is cut between the n-th label and the (n+1)th label, the controller acquires a detection target-to-detection target dimension that is a distance between the second target of the n-th label and the first detection target of the (n+1)th label in a length direction of the label tape, and the controller controls the feed motor such that, after the label is cut between the n-th label and the (n+1)th label, the label tape is fed in the second direction by a second distance based on the detection target-to-detection target dimension until the first detection target corresponding to the (n+1)th label is positioned at a position in the second direction with respect to the sensor.

In the tape printing device, the feeding of the label tape is stopped in a state in which the first detection target corresponding to the (n+1)th label is positioned at a position in the second direction with respect to the sensor. Accordingly, in the next printing operation, when the label tape is fed in the first direction, the sensor can detect the first detection target that corresponds to the (n+1)th label. It should be noted that the distance C is an example "second distance".

A method of controlling a tape printing device including a feed motor configured to serve as a drive source for feeding, in a first direction and a second direction that is opposite to the first direction, a label tape having a label mount and a plurality of labels attached on the label mount at predetermined intervals in a length direction of the label mount, a thermal head configured to perform printing to the labels in response to the feeding of the label tape in the first direction, and a cutter disposed at a position in the first direction with respect to the thermal head, the cutter being configured to cut the label tape is provided. The method includes, after printing is performed to n pieces of labels, wherein n is an integer greater than or equal to one, cutting the label tape between the n-th label and a (n+1)th label counted from a leading edge of the label tape in the first direction, and when the label tape is cut and the (n+1)th label is positioned at a print position at which printing is performed by the thermal head, controlling the feed motor such that the label tape is fed in the second direction until the (n+1)th label is displaced from the print position.

In the tape printing device, after the label tape is cut between the n-th label and a (n+1)th label, until the next printing is started, the (n+1)th label is displaced from the print position at which printing is performed by the thermal head. Accordingly, it can be prevented that residual heat remaining in the thermal head causes unnecessary printing to the (n+1)th label.

What is claimed is:

1. A tape printing device comprising:

a feed motor configured to serve as a drive source for feeding, in a first direction and a second direction that is opposite to the first direction, a label tape having a label mount and a plurality of labels attached on the label mount at predetermined intervals in a length direction of the label mount;

a thermal head configured to perform printing to the labels in response to the feeding of the label tape in the first direction;

a cutter disposed at a position in the first direction with respect to the thermal head, the cutter being configured to cut the label tape;

a controller configured to control the feed motor such that, after printing is performed to n pieces of labels, wherein n is an integer greater than or equal to one, when the label tape is cut between the n-th label and a (n+1)th label counted from a leading edge of the label tape in the first direction and the (n+1)th label is positioned at a print position at which printing is performed by the thermal head, the label tape is fed in the second direction until the (n+1)th label is displaced from the print position; and a sensor configured to detect a first detection target provided in the label tape for each label, wherein the controller controls the thermal head such that, in feeding the label tape in the first direction, after the detection of the first detection target, printing to the label corresponding to the detected first detection target is started, and the controller controls the feed motor such that, when the label tape is fed in the second direction until the (n+1)th label is displaced from the print position, after the first detection target corresponding to the (n+1)th label is detected, the label tape is fed in the second direction by a first distance.

2. A tape printing device comprising:

a feed motor configured to serve as a drive source for feeding, in a first direction and a second direction that is opposite to the first direction, a label tape having a label mount and a plurality of labels attached on the label mount at predetermined intervals in a length direction of the label mount;

a thermal head configured to perform printing to the labels in response to the feeding of the label tape in the first direction;

a cutter disposed at a position in the first direction with respect to the thermal head, the cutter being configured to cut the label tape;

a controller configured to control the feed motor such that, after printing is performed to n pieces of labels, wherein n is an integer greater than or equal to one, when the label tape is cut between the n-th label and a (n+1)th label counted from a leading edge of the label tape in the first direction and the (n+1)th label is positioned at a print position at which printing is performed by the thermal head, the label tape is fed in the second direction until the (n+1)th label is displaced from the print position; and a sensor configured to detect a first detection target and a second detection target provided in the label tape for each label, wherein the controller controls the thermal head such that, in feeding the label tape in the first direction, after the detection of the first detection target, printing to the label corresponding to the detected first detection target is started, the controller controls the cutter such that, after the second detection target corresponding to the n-th label is detected, the label tape is cut between the n-th label and the (n+1)th label, the controller acquires a detection target-to-detection target dimension that is a distance between the second target of the n-th label and the first detection target of the (n+1)th label in a length direction of the label tape, and the controller controls the feed motor such that, after the label is cut between the n-th label and the (n+1)th label, the label tape is fed in the second direction by a second distance based on the detection target-to-detection target dimension until the first detection target corresponding to the (n+1)th label is positioned at a position in the second direction with respect to the sensor.

3. A method of controlling a tape printing device comprising a feed motor configured to serve as a drive source for feeding, in a first direction and a second direction that is opposite to the first direction, a label tape having a label mount and a plurality of labels attached on the label mount at predetermined intervals in a length direction of the label mount; a thermal head configured to perform printing to the labels in response to the feeding of the label tape in the first direction; and a cutter disposed at a position in the first direction with respect to the thermal head, the cutter being configured to cut the label tape, the method comprising:

after printing is performed to n pieces of labels, wherein n is an integer greater than or equal to one, cutting the label tape between the n-th label and a (n+1)th label counted from a leading edge of the label tape in the first direction;

when the label tape is cut and the (n+1)th label is positioned at a print position at which printing is performed by the thermal head, controlling the feed motor such that the label tape is fed in the second direction until the (n+1)th label is displaced from the print position;

detecting a first detection target provided in the label tape for each label;

controlling the thermal head such that, in feeding the label tape in the first direction, after the detection of the first detection target, printing to the label corresponding to the detected first detection target is started; and controlling the feed motor such that, when the label tape is fed in the second direction until the (n+1)th label is displaced from the print position, after the first detection target corresponding to the (n+1)th label is detected, the label tape is fed in the second direction by a first distance.

* * * * *